US005097761A

United States Patent [19]

Hamu

[11] Patent Number: 5,097,761

[45] Date of Patent: Mar. 24, 1992

[54] SCREEN PRINTING FRAME STRUCTURE

[76] Inventor: Kaino J. Hamu, 16061 Dominica Cir., Huntington Beach, Calif. 92649

[21] Appl. No.: 576,673

[22] Filed: Aug. 31, 1990

[51] Int. Cl.[5] ..... B05C 17/06

[52] U.S. Cl. ..... 101/127.1; 101/128.1; 38/102.91; 160/379

[58] Field of Search ..... 101/127.1, 128, 128.1; 38/102–102.91; 160/369, 371, 374.1, 378, 379

[56] References Cited

U.S. PATENT DOCUMENTS

| | | | |
|---|---|---|---|
| 587,882 | 10/1897 | Tarnke | 160/374.1 |
| 1,901,963 | 3/1933 | Hansen | 38/102.5 |
| 3,167,004 | 1/1965 | Miller et al. | 101/127.1 |
| 3,908,293 | 9/1975 | Newman | 101/127.1 |
| 4,451,997 | 6/1984 | Jones | 38/102.2 |

FOREIGN PATENT DOCUMENTS

| | | | |
|---|---|---|---|
| 2106447 | 4/1983 | United Kingdom | 101/127.1 |

*Primary Examiner*—Edgar S. Burr
*Assistant Examiner*—Ren Yan
*Attorney, Agent, or Firm*—Boniard I. Brown

[57] ABSTRACT

A frame structure for supporting a stretched printing screen of the kind used in the so-called silkscreen printing process. The frame structure is intended for use in screen printing relatively large surface areas, and comprises frame members which are joined at their ends to form an open rectangular screen frame across one side of which the printing screen is stretched. At least two opposing frame members of the screen frame have a unique truss construction which resists either or both vertical bending or sagging of the frame when it is raised and lowered during a screen printing operation and inward bowing of the opposing frame members in the plane of the frame by tension in the stretched printing screen.

9 Claims, 4 Drawing Sheets

FIG—.1

SCREEN PRINTING FRAME STRUCTURE

BACKGROUND OF THE INVENTION

1. Field of the Invention

This invention relates generally to so-called silk screen printing equipment and more particularly to a novel, relatively large reinforced screen printing frame designed for very large area printing applications.

2. Prior Art

The art of screen printing, often referred to as silk screen printing, is very well known and extensively used for a vast assortment of printing applications and hence need not be elaborately explained in this disclosure. Suffice it to say that screen printing involves the use of an open rectangular screen frame across one side of which is placed a printing screen having a pattern of open and blocked holes corresponding to the image to be printed. Along at least two opposite sides, and often along all four sides, of the screen frame are screen gripping and tensioning means, such as rollers, for gripping the screen edges and stretching the screen edgewise to a taut condition suitable for screen printing. The screen is placed in contact with a workpiece to be printed, and a screen printing ink is spread across the upper side of the screen to force the ink through the open screen holes onto the underlying workpiece. Many screen printing operations involve the sequential use of different printing screens and/or different color inks to produce a finished print.

The present invention is concerned with printing relatively large surface areas, such as areas on the order of 50 feet or more in length and several feet in width. One such large surface area printing application, for example, involves the printing of certain designs, indicia, and the like on a facing sheet for the interior of a Boeing airliner. In the past, it has been neccessary to print these designs, indicia, etc on several separate sheets which then must be applied in proper alignment to the airliner interior. Simultaneously printing of all the required designs and indicia on a single sheet in a single printing operation and application of this single sheet to the airliner is substantially more economical and results in a vastly superior airliner interior.

Up to the present time, it has been either impractical or totally impossible to make such large surface area screen prints. This is due to the fact that the existing screen frame structures are not sufficiently rigid to enable their construction in the large sizes necessary for such large surface printing applications. Thus, the existing screen frame structures, if enlarged sufficiently for the large surface area screen printing applications contemplated in this invention, would be subject to two modes of bending which would seriously degrade or totally destroy their screen printing capability. One bending mode would be gravity-induced vertical bending orsagging which would occur in a large frame of conventional construction when it is raised and lowered in the course of screen printing operations. Such a conventional printing frame on the order of 50 feet or more in length, for example, would sag several inches vertically at its center when lifted. The second bending mode to which a large screen frame of conventional construction would be subject is inward bending of its long frame members in the plane of the printing screen by the tension forces in the screen when the screen is stretched. Both of these modes of bending or deflection would create non-uniform tension in the printing screen and thereby severe distortions in the resulting print.

SUMMARY OF THE INVENTION

This invention provides an improved screen printing frame structure for large surface area screen printing applications and including a screen frame proper which is uniquely constructed and arranged to resist vertical bending or sagging of the frame when the frame structure is lifted in the course of screen printing operations and resist inward bending of the frame sides by printing screen tension when the screen is stretched. To this end, the screen frame includes frame members located along the four sides of the frame and rigidly joined to one another at the frame corners. These frame members define and bound a rectangular opening through the frame. At least the opposing frame members which are most subject to such bending by gravity or screen tension have a unique open truss construction which effectively resists either or both types of frame bending modes referred to above. The reinforced screen frame of the invention is relatively light in weight to permit handling of the frame structure with relative ease during a screen printing operation and is uniquely adapted to be cast in one piece from a suitable metal, such as aluminum.

Each truss frame member of a present screem frame has an inner longitudinal truss portion along and bounding the adjacent side of the frame opening, an outer longitudinal truss portion laterally spaced from the inner truss member, and additional truss portions joining the inner and outer truss portions in such a way as to form a plurality of triangular load bearing truss sections. In one disclosed frame structure of the invention, the truss frame members are located in planes transverse to the plane of the screen frame and resist primarily vertical bending or sagging of the frame when it is raised and lowered in the course of a screen printing operation. In another disclosed frame structure, the truss frame members are located substantially in the plane of the screen plane and resist primarily inward bending of the truss frame members by the tension forces in the stretched printing screen. A third disclosed frame structure of the invention has truss frame members which include truss structures in both of the above planes and resist both bending modes.

Along at least two opposite frame members of the screen frame are means for gripping opposite edges of a printing screen extending across the normally bottom side of the frame and stretching the screen edgewise to the proper screen tension for screen printing. In the preferred inventive embodiments described herein, these screen gripping and tensioning means are rollers rotatably supported at their ends on the frame. Screen gripping and tensioning rollers which are supported on truss frame members of the screen frame are contained within cavities which extend longitudinally through and open laterally through the normally undersides of the inner longitudinal truss portions of the truss frame members.

DESCRIPTION OF THE PREFERRED EMBODIMENTS

Figure 1:
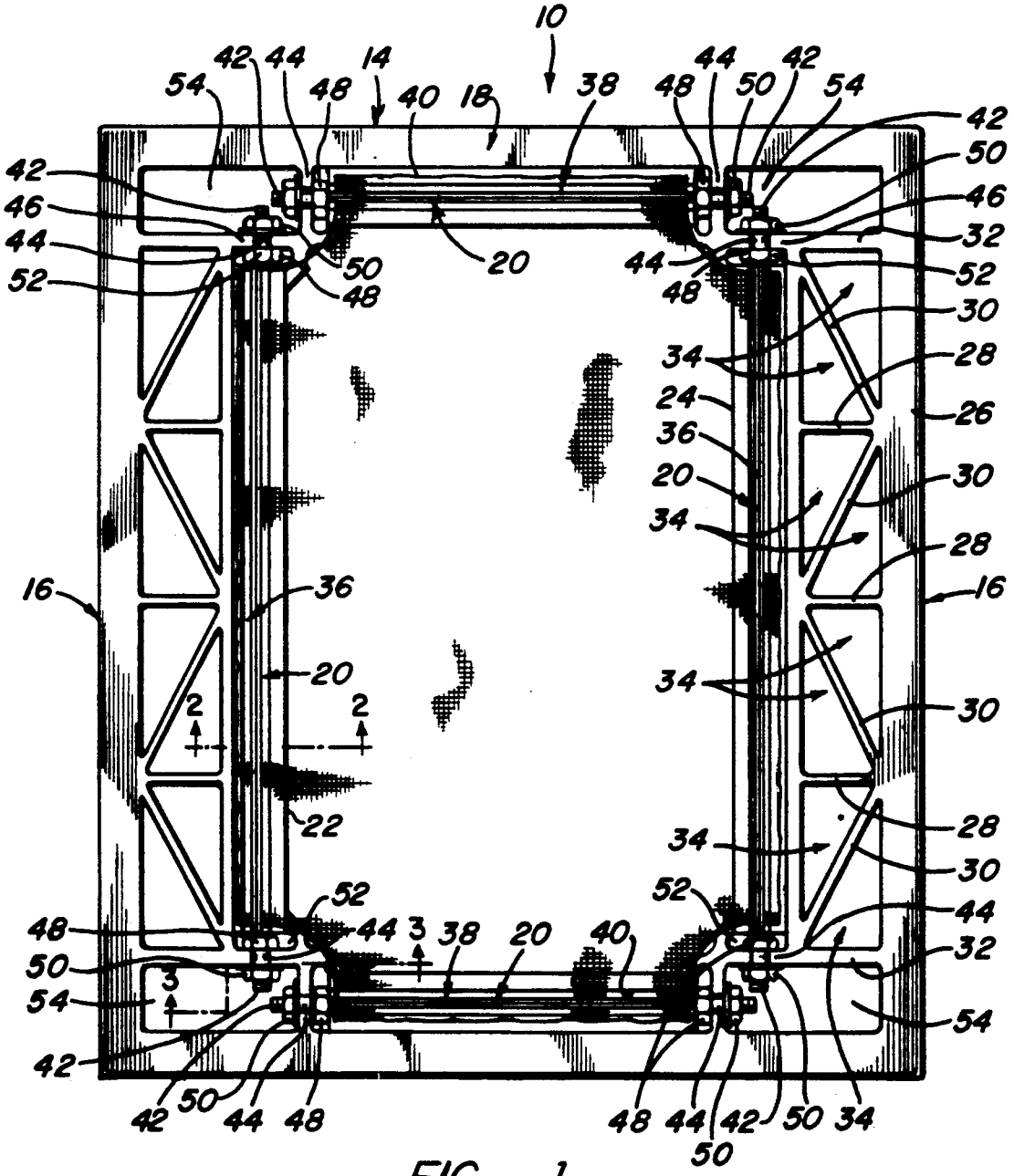
FIG. 1 is a plan view of the normally bottom side of a reinforced screen printing frame structure according to the invention having two opposing truss frame members.
Figure 2:
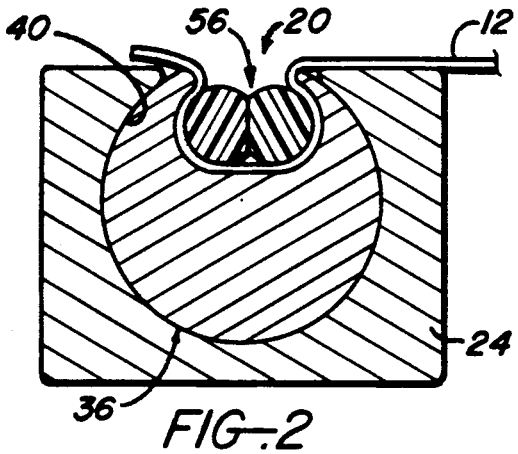
FIG. 2 is an enlarged section taken on line 2—2 in FIG. 1.
Figure 3:
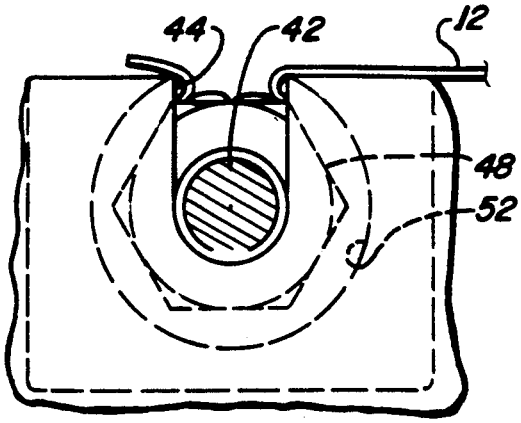
FIG. 3 is an enlarged section taken on line 3—3 in FIG. 1.

Turning now to these drawings and first to FIGS. 1—3, there is illustrated a screen printing frame structure 10 according to the invention supporting a printing screen 12. The frame structure 10 includes a rectangular screen frame 14 proper composed of four frame members 16 and 18 along the four sides, respectively, of the frame and screen gripping and tensioning means 20 on at least certain of the frame members. The adjacent ends of these frame members are rigidly joined to one another at the four corners of the frame. The four frame members define and circumferentially bound a rectangular opening 22 through the frame. As described in more detail later, the screen gripping and tensioning means 16 are adapted to grip the edges of the screen 12 and stretch the screen edgewise across the nomally underside (i.e. the side shown in FIG. 1) of the frame 14 and its opening 22.

As mentioned earlier, a screen printing frame structure according to the invention is intended for printing relatively large surface areas. For example an area to be printed may measure 50 feet or more in length and several feet in width. For such use, the screen frame 14 is elogated in the vertical direction in FIG. 1 and will have a length and width slightly greater than those of the surface area to be printed. In other words, the frame will have a length of 50 feet or more and a width of several feet.

During a screen printing operation, it is necessary to frequently raise and lower the screen frame structure 10. The improved screen frame structure of the invention is designed to be thus raised and lowered, either manually or mechanically, without support other than at the points, such as the ends, at which the lifting forces are applied to the frame structure. During this raising and lowering of the frame structure, gravitational force will produce on the frame 14 and more specifically on its frame members 16, 18, especially its relatively long longitudinal frame members 16 in FIG. 1, relatively large vertical bending loads which tend to cause these frame members to bow downwardly or sag between their ends. This bending mode is hereafter referred as a vertical bending mode. Tensioning of the printing screen 12 on the frame structure also produces bending loads on the frame members, particularly the long frame members 16, which tend to bow or bend them inwardly in the plane of the screen between their ends. This latter bending mode is hereafter referred to as an in-plane bending mode. Such bowing or bending of the screen frame 14 must be avoided, since even relatively slight bending or sagging of the frame will create non-uniform tension in the printing screen 20. This non-uniform screen tension, in turn, will produce distortions in the screen print being made. The screen frame improvements of this invention substantially eliminate detrimental bending of the screen frame or at least limit any bending which does occur to such a small amount that it has no significant adverse effect on the screen print being made.

According to the invention, this is accomplished by providing at least those frame members of the screen frame which are subject to detrimental bending, such as the long frame members 16 in FIG. 1, with a unique truss construction or configuration which will effectively resist both of the frame bending modes referred to above to a sufficient extent to avoid detrimental bending of the frame. To this end, the long frame members 16 in FIG. 1 are truss frame members which resist primarily the in-plane bending mode of the frame 14, that is inward bending or bowing of these frame members in the plane of the printing screen 12 by the tension forces in the screen.

Each truss frame member 16 of the screen frame 14 comprises laterally spaced inner and outer longitudinal load bearing truss portions 24, 26 and additional load bearing truss portions 28, 30, 32 rididly extending between and rigidly joining the longitudinal truss portions 24, 26 in such a way as to form a plurality of generally triangular load bearing truss sections 34. The inner load bearing truss portions 24 of the truss frame members 16 are located along and define the adjacent edges of the frame opening 22. The remaining end frame members 18 extend between and are rigidly joined at their ends to the ends the inner and outer longitudinal truss portions 24, 26 so as to form a rigid rectangular frame. The truss structures of the truss frame members 16 in FIG. 1 are disposed substantially in the plane of the frame 14 and resist primarily inward bending of these frame members in the plane of the frame when the printing screen 12 is stretched edgewise as described below. It will be appreciated, however, that these truss structures also resist to some extent vertical bending of the frame. 14.

The screen gripping and tensioning means 20 comprise screen gripping rollers 36 on the truss frame members 16 and screen gripping rollers 38 on the end frame members 18. The screen gripping rollers 36 on the truss frame members 16 extend longitudinally through longitudinal cavities 40 within and opening laterally through the normally undersides (i.e. the upper sides in FIG. 1) of the inner truss portions 24 of the truss frame members. At the ends of the rollers 36 are threaded coaxial shafts 42 which extend through slots 44 in end walls 46 at the ends of the inner truss portions 24 to rotatably support the rollers on the frame for turning on the longitudinal axes of their respective truss portion cavities 40. Threaded on each roller shaft 42 at opposite sides of the adjacent roller cavity end wall 46 are nuts 48 and 50. About each inner nut 48 is a recess 52 to receive a wrench for engaging the inner nut. The frame 14 has corner openings 54 to receive a wrench for engaging the outer nuts 50.

The screen gripping rollers 38 are essentially identical with, and are mounted on the end frame members 18 of the screen frame 14 in the same manner as, the rollers 36. Thus, rollers 38 extend longitudinally through longitudinal cavities 40 in and opening laterally through the normally undersides of the end frame members 18. These rollers have threaded coaxial end shafts 42 which extend through slots 44 in endwalls of the latter cavities 40 to rotatably support the rollers on the frame members 18 and mount nuts 48 and 50 at opposite sides of the latter end walls which are engagable by wrenches in the same manner as the nuts on the rollers 36.

Each roller 36, 38 has means 56 for gripping an edge of the printing screen 12, and the roller end shafts 42 are reverse threaded, all in the same manner as explained in my co-pending application Ser. No. 07/564,752, whereby the rollers may be rotated to tension the printing screen 12 and then secured against rotation to retain the screen tension by wrenches engaging the roller nuts 48 and 50. This tensioning of the screen creates forces on the frame members 16, 18 which act laterally inward on the frame members and tend to bend or bow the members inwardly in the plane of the screen.

Figure 4:
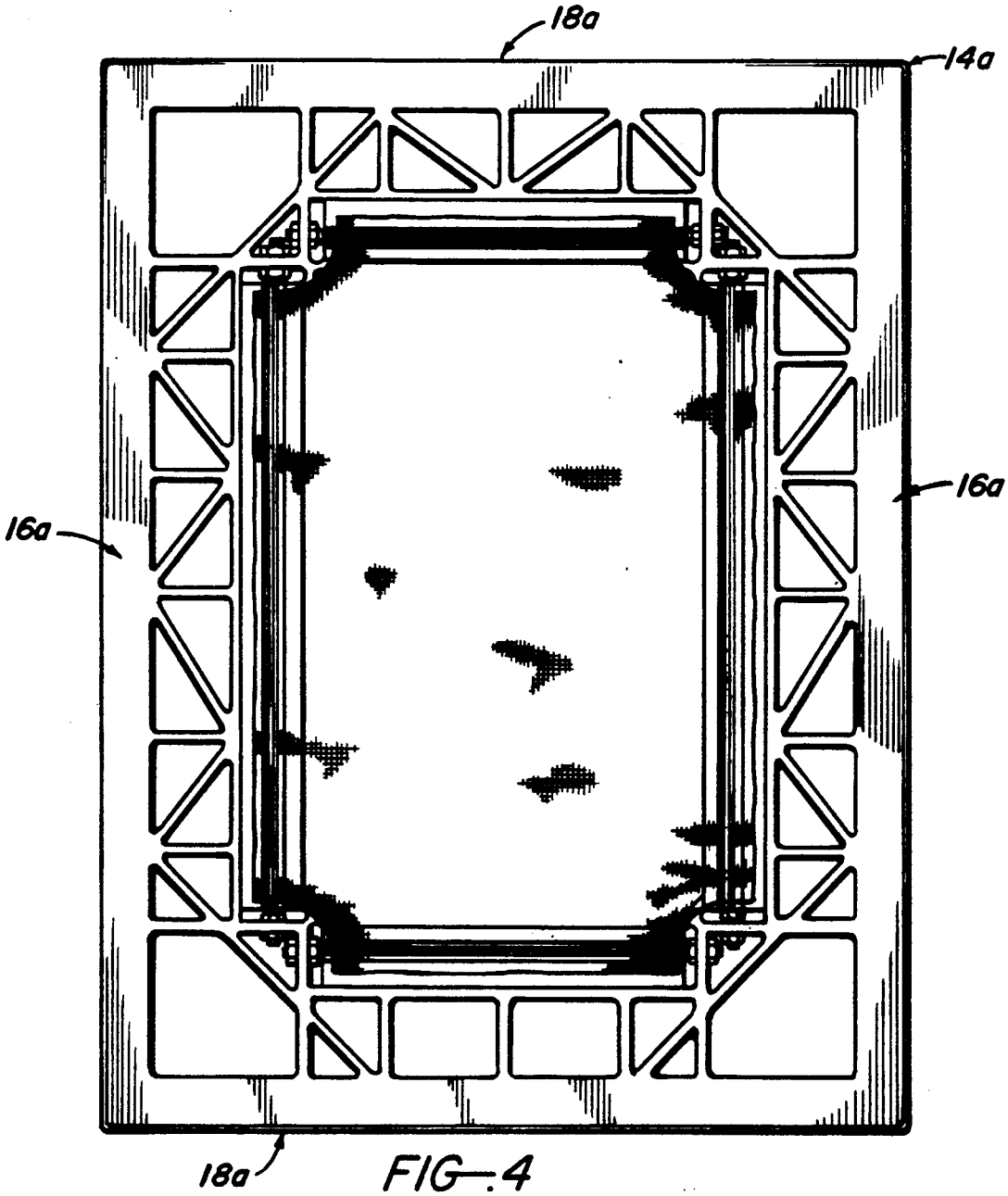
FIG. 4 is a plan view of a modified screen printing frame structure according to the invention having four truss frame members.

As explained earlier, such inward bending or bowing of the frame members, if allowed to occur, would create non-uniform tension in the screen and resulting distortions in screen prints made with the frame structure. In the particular screen printing frame structure illustrated in FIGS. 1-3, the longitudinal frame members 16 are relatively prone to such inward bending because of their long length. The truss configuration or construction of these frame members is designed to resist such inward bending or limit any inward bending which does occur to such a small amount that it does not adversely effect the screen prints. The end frame members 18, on the other hand, are sufficiently short to avoid any detrimental inward bending of these end members by screen tension so that they are not provided with a truss construction. In some cases, however, the frame dimensions may be such as to require reinforcement of all four frame members. FIG. 4 illustrates such a four-side-reinforced screen frame **14*a* according to the invention in which all four frame members 16*a*, 18*a* are truss frame members essentially identical to those described in connection with FIG. 1**.

A unique feature of the screen frames 14 and **14*a*** resides in the fact that all of the frame surfaces are either substantially parallel to the plane of the frame or substantially normal to this plane or rounded in such a way that the frames may be cast in one piece from a suitable material, such as aluminum. It will be evident to those skilled in the art, however, that the frames may also be fabricated from several separate parts which are rigidily bolted, welded, or otherwise joined to one another.

Figure 5:
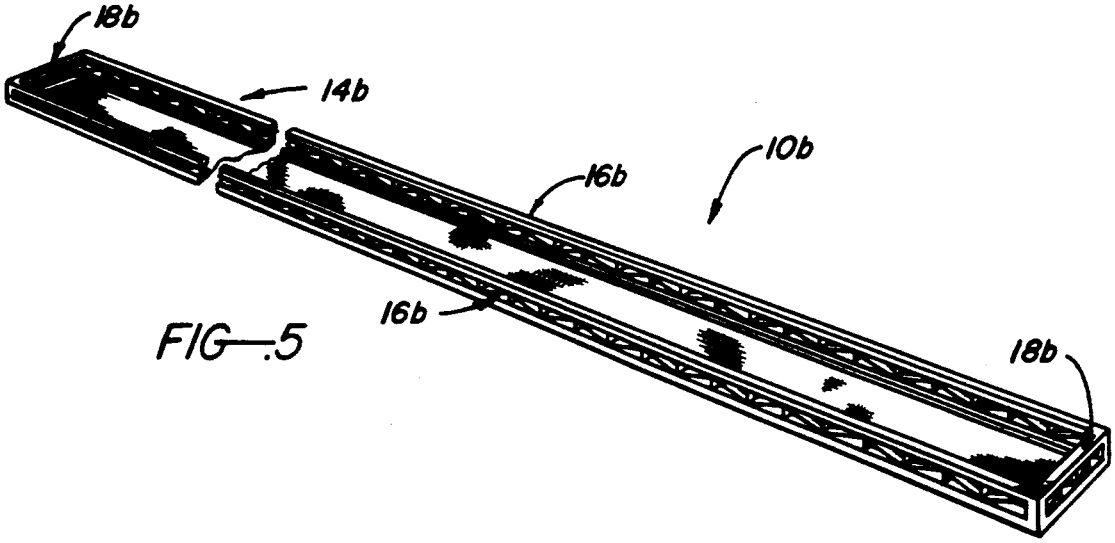
FIG. 5 is a perspective view of a further modified screen printing frame structure according to the invention.

The screen printing frames described above are designed to resist the in-plane frame bending mode discussed earlier, that is inward bending or bowing of the frame members in the plane of the frame. The modified screen printing frame structure **10*b* illustrated in FIG. 5 has a screen frame 14*b* which is designed to resist the earlier discussed vertical bending mode in which the frame tends to bow or sag vertically when raised. This modified frame is relatively long (i.e. 50 feet or more) and narrow (i.e. a few feet) and has relatively long longitudinal frame members 16*b* and relatively short end frame members 18*b*. These frame members 16*b* have a truss configuration or construction essentially identical to that of the earlier described screen frames and constitute truss frame members which are designed to resist primarily the earlier discussed vertical bending mode of the frame 14*b***.

Figure 6:
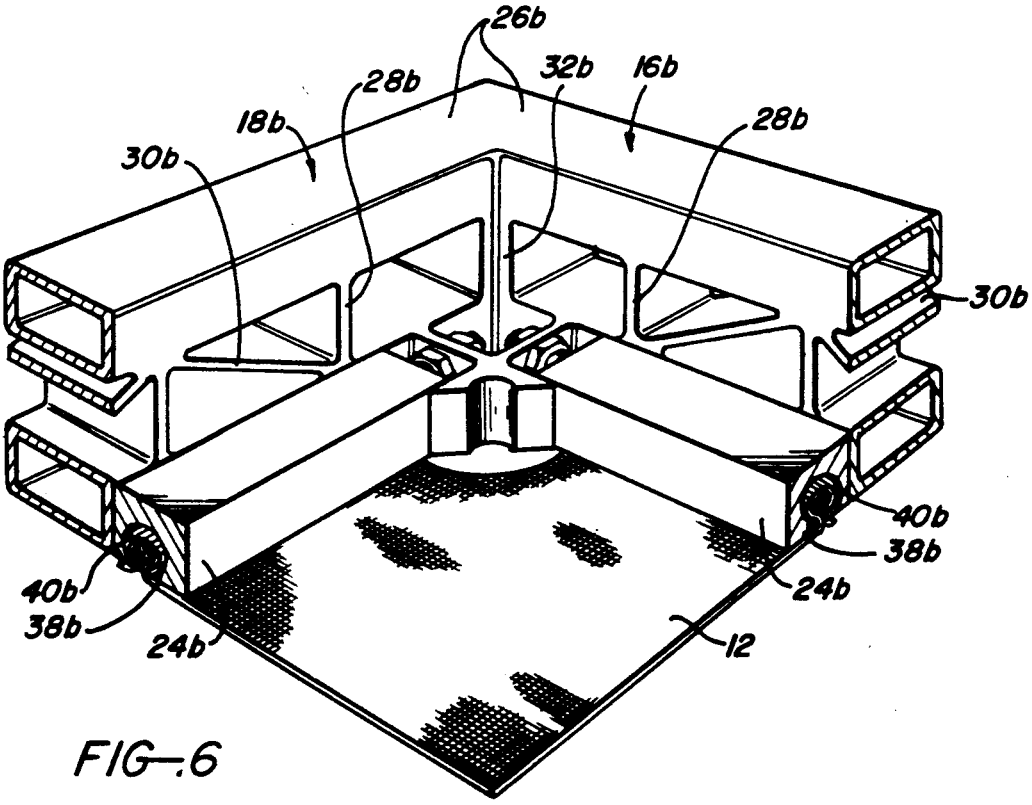
FIG. 6 is an enlarged fragmentary perspective view of one corner of the frame structure in FIG. 5.

To this end, the truss frame members **16*b* and 18*b* are disposed in planes normal to the plane of the screen frame 14*b* rather than in the plane of the frame as in the earlier embodiments. These truss frame members have lower inner longitudinal load bearing truss portions 24*b*, upper outer longitudinal load bearing truss portions 26*b*, and intervening load bearing truss portions portions 28*b*, 30*b*, 32*b* rigidly joining the inner and outer truss portions to form a plurality of generally triangular load bearing portions. The lower inner longitudinal truss portions 24*b* project laterally inward parallel to the plane of the frame and have longitudinal cavities 40*b* which open laterally through the normally underside of the frame (the lower side in FIGS. 5 and 6) and contain screen gripping and tensioning rollers 36*b*, 38*b* like those in the earlier embodiments. These rollers are rotatably mounted on the frame 14*b* in exactly the same way as described earlier in connection with FIGS. 1-3**.

Figure 7:
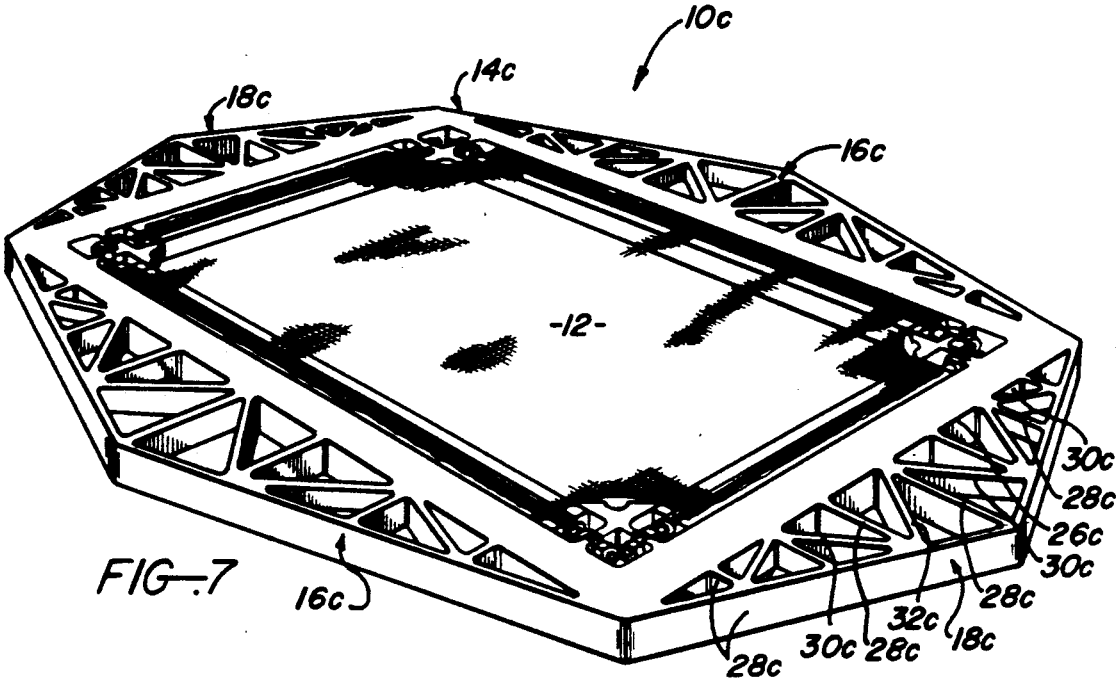
FIG. 7 is a perspective view of a further modified screen printing frame structure according to the invention.
Figure 8:
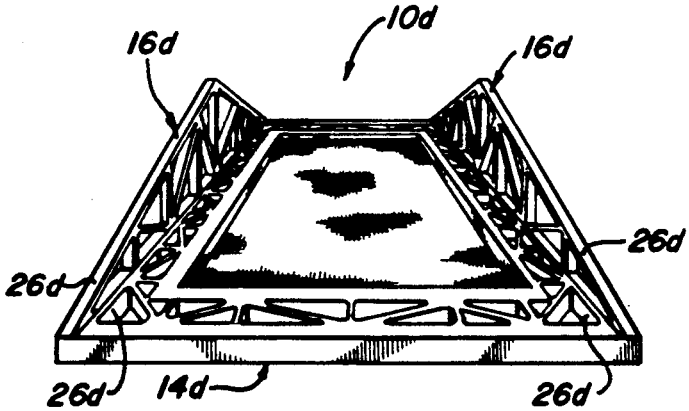
FIG. 8 is a perspective view of a further modified screen printing frame structure according to the invention.

The modified screen printing frame structure **10*c* of FIG. 7 has a screen frame 14*c* which is identical to that of FIG. 4 except for the truss configurations of the truss frame members 16*c*, 18*c* in FIG. 7. In contrast to the truss frame members 14*a*, 16*a* in FIG. 4, the outer truss portions 26*c* of the truss frame members 16*c*, 18*c* have two oblique ends which join one another at the longitudinal centers of their truss members and converge toward their respective inner truss portions 24*c* from these centers toward the ends of the truss frame members. Accordingly, each truss frame member 16*c*, 18*c*** has a peaked configuration so that its in-plane bending strength increases from its ends toward its center.

The modified screen printing frame structure **10*d* is also identical to that of FIG. 4 except that the longitudinal truss frame members 16*d* of the screen frame 14*d* of the frame structure 10*d* have additional vertical truss sections 16*d*' which resist bending or bowing of the frame in its vertical bending mode. These additional vertical truss sections include upper outer longitudinal load bearing truss portions 26*d*' over the outer truss portions 26*d* of the basic FIG. 4 frame, and intervening load bearing truss portions 28*d*', 30*d*' rigidly joining the truss portions 26*d*, 26*d*' in such a way as to form a plurality of vertical, generally triangular load bearing truss sections. The screen frame 14*d*** is thus reinforced against bending or bowing in both the in-plane and vertical bending modes.

Thus there has been shown and described a novel screen printing frame structure which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

I claim:

1. A screen printing frame structure comprising:

an open rectangular frame including frame members along the four sides, respectively, of said frame rigidly joined to one another at the frame corners and definging and bounding a rectangular opening through the frame opening to opposite sides of the plane of the frame, the frame members along at least two opposite sides of said frame comprising open trusses each including an inner elongate load bearing truss portion extending along and bounding the adjacent side of said frame opening and rigidly joined at its ends to the remaining frame members along the two remaining opposite sides of said frame, an outer elongate load bearing truss portion extending generally lengthwise of and spaced laterally from said inner truss portion at least between the ends of said truss portions and rigidly joined at its ends to said remaining frame members, and additional load bearing truss portions extending between and rigidly joined to said inner and outer truss portions, and screen gripping and tensioning means comprising an elongate cavity within and extending longitudinally through each said inner truss portion and opening laterally to said one side of the plane of said frame, and a screen gripping roller within each cavity including means for gripping an edge of a screen extending across said frame.

2. A screen printing frame structure according to claim 1 wherein:

said trusses are disposed in said plane of said frame.

3. A screen printing frame structure according to claim 1 wherein:

each truss is disposed in a plane transverse to said plane of said frame and project beyond the opposite side of said last mentioned plane so as to not obstruct contact of the printing screen with a work piece to be printed.

4. A screen printing frame structure according to claim 1 wherein:

said truss portions are disposed in said plane of said frame, and each truss further includes a third elongate load bearing truss portion extending generally lengthwise of and spaced laterally from said outer truss portion of the respective truss at least between the ends of the respective outer and third truss portions and disposed in a plane transverse to the plane of said frame and containing the outer truss portion of the respective truss, and additional load bearing truss portions extending between and rigidly joined to said outer truss portion and third truss portion of the respective truss, and said third truss portion and latter additional truss portions of each truss project beyond the opposite side of said plane of said frame so as not obstruct contact of the printing screen with a workpiece to be printed.

5. A screen printing frame structure according to claim 1 wherein:

said trusses include means at the ends of said cavities rotatably supporting said rollers.

6. A screen printing frame structure according to claim 1 wherein:

said inner and outer truss portions of each truss are relatively straight and parallel, and said additional truss portions of each truss extend at various angles relative to the respective inner and outer truss portions so as to form triangular load bearing sections.

7. A screen printing frame structure comprising:

an open rectangular frame including frame members along the four sides, respectively, of said frame rigidly joined to one another at the frame corners and definging and bounding a rectangular opening through the frame to opposite sides of the plane of the frame, said frame having two opposite, relatively long sides and two remaining sides between said long sides, and wherein the frame members along said long sides comprise open trusses each including an inner elongate load bearing truss portion extending along and bounding the adjacent side of said frame opening and rigidly joined at its ends to the frame members along said remaining frame sides, an outer elongate load bearing truss portion extending generally lengthwise of and spaced laterally from the respective inner truss portion and rigidly joined at its ends to said frame members along said remaining frame sides, and additional truss portions extending between and at various angles relative to the respective inner and outer truss portions and rigidly joined to the respective inner and outer truss portions so as to form a plurality of open triangular load bearing sections, and screen gripping and tensioning means comprising cavities extending longitudinally through said inner truss portions of said trusses and opening laterally to one side of said plane of said frame, and screen gripping and tensioning rollers within said cavities having extending coaxial shafts at the ends of the rollers, and walls at the ends of said cavities containing openings journalling said roller shafts to rotatably support said rollers in said cavities.

8. A screen printing frame structure according to claim 7 wherein:

said wall openings comprise slots opening endwise to one side of the plane of said frame for lateral insertion and removal of said rollers into and from said cavities.

9. A screen printing frame structure comprising:

an open rectangular frame including frame members along the four sides, respectively, of said frame rigidly joined to one another at the frame corners and defining and bounding a rectangular opening through the frame, screen gripping and tensioning means along at least two opposite frame members for gripping opposite edges of a printing screen extending across one side of said frame and tensioning said screen edgewise, and wherein said frame members along two opposite sides comprise truss frame members forming truss structures including longitudinal load bearing truss portions extending lengthwise of and spaced laterally of the respective frame members, and additional truss portions extending between and rigidly joined to the longitudinal truss portions of each truss frame member so as to form a plurality of open triangular load bearing sections, the truss frame members along two opposing sides of said frame opening have a peaked truss configuration, and said longitudinal truss portions of each peaked truss frame member include a relatively straight inner longitudinal truss portion along and bounding the adjacent side of said frame opening and an outer longitudinal truss portion having end portions disposed at an obique angle relative to one another at the side of said outer truss portion adjacent said inner truss portion, whereby the spacing between said longitudinal truss portions of each peaked truss frame member increases from the ends to the longitudinal centers of the respective longitudinal truss portions, and the bending strength of said peaked truss frame members increases from their ends to their longitudinal centers.

* * * * *